United States Patent [19]

Weiland

[11] 4,168,054

[45] Sep. 18, 1979

[54] TUBING CONNECTION

[76] Inventor: Edward E. Weiland, Union Lake, Oakland County, Mich. 48055

[21] Appl. No.: 943,698

[22] Filed: Sep. 19, 1978

[51] Int. Cl.[2] ..... E04H 17/14

[52] U.S. Cl. ..... 256/73; 403/242; 403/283; 256/65

[58] Field of Search ..... 403/242, 263, 277, 248, 403/283; 256/65, 66, 67, 68, 69, 70, 73, 24; 29/521, 516

[56] References Cited

U.S. PATENT DOCUMENTS

| | | | |
|---|---|---|---|
| 470,514 | 3/1892 | Simpson | 256/65 |
| 1,649,363 | 11/1927 | Parsons | 29/521 UX |
| 3,082,850 | 3/1963 | Weening | 29/521 X |
| 3,848,855 | 11/1974 | Weiland | 403/263 X |

*Primary Examiner*—Andrew V. Kundrat
*Attorney, Agent, or Firm*—Joseph D. Odenweller

[57] ABSTRACT

A tubing connection comprising an elongated opening in a first tube member and a pair of opposed slots cut in the end of a second tube forming a pair of tabs which are flattened and inserted through the elongated opening. The tabs are spread to conform with the inside contour of the first tube member and a tubular insert is press fit between the spread tabs. A perforation is punched through the first tube member at a location such that it penetrates one of the spread tabs and the tubular insert. The perforation is indented locking the tab to the first tube member to prevent rotation giving a strong rigid connection.

2 Claims, 4 Drawing Figures

TUBING CONNECTION

BACKGROUND OF THE INVENTION

In U.S. Pat. No. 3,776,523 I describe a tubing connection in which tabs on the end of one tube are inserted through an opening in a second tube and spread. A tubular insert is pressed inside the spread tabs. In U.S. Pat. No. 3,848,855 I describe an improvement which serves to make the connection more rigid.

SUMMARY OF THE INVENTION

According to the present invention I provide a means of stiffening the above tubing connection by having an inwardly indented perforation which goes through the second tube member, one of the spread tabs and the tubular insert.

DESCRIPTION OF THE PREFERRED EMBODIMENTS

Figure 1:
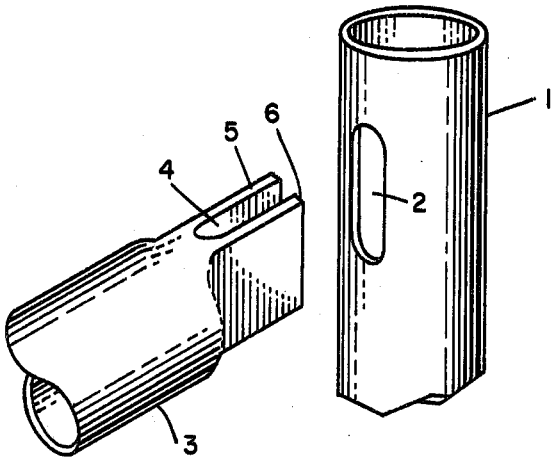
FIG. 1 is a perspective view showing the second tube member with the flattened tabs prior to insertion through the elongated opening in the first tube member.

Referring to FIG. 1, first tube member 1 has a longitudinally aligned elongated opening 2 in its side wall. Second tube member 3 has opposed longitudinal recesses 4 in its side wall at an end forming a pair of tabs 5 and 6 which are flattened.

Figure 2:
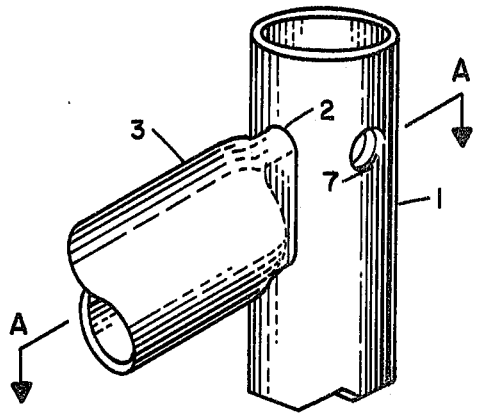
FIG. 2 is a perspective view of the completed connection showing the indented perforation.

In FIG. 2 flattened tabs 5 and 6 are inserted through opening 2 in first tube member 1. Tabs 5 and 6 spread inside tube member 1 and a tubular insert is pressed inside the spread tabs although this is not shown in FIG. 2. An indented perforation 7 is about 90° from elongated opening 2 in tube member 1.

Figure 3:
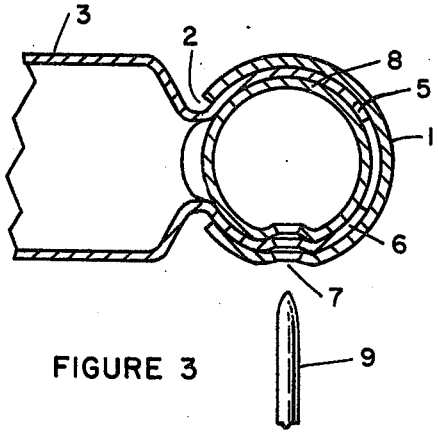
FIG. 3 is a cross-section of FIG. 2 taken at AA through the indented perforation showing the spread tabs and tubular insert inside the first tubular member.

FIG. 3 shows the detailed structure of the connection. Tabs 5 and 6 are spread outwardly inside first tube member 1 to substantially conform with the inside surface of tube member 1. A tubular insert 8 is tightly fitted inside spread tabs 5 and 6. Indented perforation 7 extends through the side wall of tube member 1, one of the spread tabs 6 and tubular insert 8. The indented perforation prevents rotation of tab 6 inside first tube member 1 resulting in a very rigid connection.

If more rigidity is required additional indented perforations can be provided through the same three members or at an opposite location extending through the side wall of tube member 1, tab 5 and insert 8. This is not shown because it is substantially the same as the one shown.

The connection is easily formed by cutting the elongated recesses 4 in the end of tube member 3 and flattening the side wall to form tabs 5 and 6. An elongated opening 2 is punched or cut through the side wall of first tubular member 1. Tabs 5 and 6 are inserted through opening 2 and are easily spread by forcing a cylindrical tool tapered at one end between the tabs. Then insert 8 is pressed between spread tabs 5 and 6 to hold them firmly against the inside of tube member 1. Finally an opening is pierced through tube member 1, tab 6 and insert 8 using a pointed tool 9 shown after being withdrawn from the indented perforation. Tool 9 can be cylindrical or can have some other cross-section because the indented perforation need not be circular.

Figure 4:
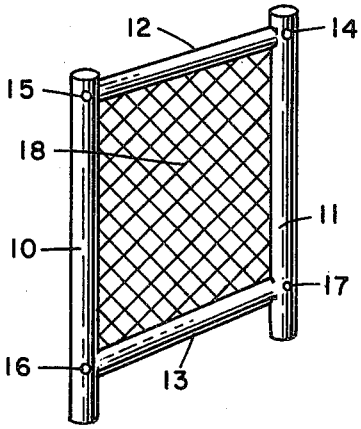
FIG. 4 shows a rectangular frame with fencing in place.

The connection can be used to make a wide variety of structures that require the connection of one tube member to a second tube member. One such structure is a rectangular frame used for a gate. Such a frame is shown in FIG. 4 in which a pair of substantially parallel spaced apart tube members 10 and 11 and a second pair of substantially parallel spaced apart tube members 12 and 13 are connected to form a rectangular frame. Each of the connections is constructed as described above. The indented perforations in the finished frame are concealed by pressing small plastic plugs into each of indented perforations 14, 15, 16 and 17. Fencing 18 is then installed in the completed frame. The frame with fencing can be used to construct enclosures such as dog kennels by merely clamping several of the pre-fabricated frames together in upright position. The frames are ideally suited for use as gates where their rigid connections resist twisting even when the lower part of the gate drags through mud or snow.

I claim:

1. A tubing assembly comprising a connection of a first tube member to a second tube member, said first tube member having a longitudinally aligned elongated opening in its side wall, said second tube member having opposed longitudinal recesses in its side wall at an end forming a pair of tabs extending from said end, said tabs being flattened and extending through said opening, said tabs being spread outwardly inside said first tube member to substantially conform with the inside surface of said first tube member, a tubular insert tightly fitted inside said outwardly spread tabs and at least one indented perforation through (1) the side wall of said first tube member, (2) one of said tabs inside said first tube member and (3) said tubular insert, said indented perforation preventing rotation of said tabs within said first tube member resulting in a rigid tubing connection.

2. A tubing assembly of claim 1 comprising a first pair of substantially parallel spaced apart tubular members and a second pair of substantially parallel spaced apart tubular members, each of said first pair of tubular members having longitudinally aligned elongated openings in their side walls proximate to each end, each of the two openings in each of the first tubular members being in substantial longitudinal alignment with the other elongated opening in such first tubular member, each of said second pair of tubular members having opposed longitudinal recesses in their side wall at both ends forming a pair of tabs extending from both ends of each of the second tubular members, said tabs being flattened, the tabs at one end of each of said second tubular members extending through the elongated openings in one of said first tubular members, the tabs at the other end of each of said second tubular members extending through the elongated openings in the other of said first tubular members, said first and said second pairs of tubular members forming a substantially rectangular frame, said tabs being spaced outwardly inside said first tubular members to substantially conform with the inside surface of said first tubular members, tubular inserts tightly fitted inside said outwardly spread tabs forming a tubing connection at each of the four corners of said rectangular frame and at least one indented perforation at each of said four corners through (1) the side wall of said first tubular members, (2) one of said tabs inside said side wall and (3) said tubular insert inside said spread tabs, said indented perforations preventing rotation of said tabs within said first tubular members resulting in a rigid rectangular frame.

* * * * *